US009254698B2

(12) United States Patent
Vila et al.

(10) Patent No.: US 9,254,698 B2
(45) Date of Patent: Feb. 9, 2016

(54) PRINTING APPARATUS

(75) Inventors: Ignasi Vila, Barcelona (ES); Macia Sole, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 2536 days.

(21) Appl. No.: 11/698,068

(22) Filed: Jan. 26, 2007

(65) Prior Publication Data

US 2008/0181709 A1 Jul. 31, 2008

(51) Int. Cl.
*B41J 15/02* (2006.01)
*B65H 19/12* (2006.01)

(52) U.S. Cl.
CPC ..... *B41J 15/02* (2013.01); *B65H 19/126* (2013.01); *B65H 2601/322* (2013.01); *B65H 2601/325* (2013.01); *B65H 2801/12* (2013.01)

(58) Field of Classification Search
CPC . B41J 15/02; B65H 19/126; B65H 2601/322; B65H 2601/325; B65H 2801/12
USPC ..... 248/316.8; 347/104
See application file for complete search history.

(56) References Cited

U.S. PATENT DOCUMENTS

| | | | | | |
|---|---|---|---|---|---|
| 4,781,336 | A * | 11/1988 | Rosenthal et al. | ..... | 242/422.8 |
| 4,792,105 | A * | 12/1988 | Imaseki | ..... | 242/598.3 |
| 5,187,532 | A | 2/1993 | McNew | ..... | 355/309 |
| 5,684,570 | A | 11/1997 | Larsen | ..... | 355/72 |
| 5,911,382 | A | 6/1999 | Wilson | ..... | 242/419.6 |
| 6,361,229 | B1 * | 3/2002 | Shinga | ..... | 400/613 |
| 6,595,463 | B2 | 7/2003 | Miyazaki | ..... | 242/598.2 |
| 6,755,499 | B2 * | 6/2004 | Castano et al. | ..... | 347/19 |
| 7,448,505 | B2 * | 11/2008 | DeMent | ..... | 211/59.4 |
| 2002/0096075 | A1 | 7/2002 | Kaya | ..... | 101/475 |
| 2004/0036755 | A1 * | 2/2004 | Guillen et al. | ..... | 347/104 |
| 2007/0063086 | A1 * | 3/2007 | Itoh et al. | ..... | 242/348.4 |

FOREIGN PATENT DOCUMENTS

| | | | | |
|---|---|---|---|---|
| FR | 2774667 | * 9/1998 | ..... | B65H 16/08 |
| JP | 09-100026 | * 4/1997 | ..... | B65D 19/02 |
| JP | 2002-302305 | * 10/2002 | ..... | B65H 16/08 |

* cited by examiner

*Primary Examiner* — Blake A Tankersley
*Assistant Examiner* — Marissa Ferguson Samreth

(57) ABSTRACT

A printing apparatus comprises supports for holding a roll of print media during printing, said supports being accessible from one side of the printer to insert a roll of print media, and an auxiliary media tray suitable for holding in a stable position a roll of print media placed with its outer surface resting on the tray, said auxiliary tray being attached to the printer on the same side of the printer from where the supports for the roll of print media are accessible.

17 Claims, 5 Drawing Sheets

PRINTING APPARATUS

BACKGROUND

The present invention relates to a printing apparatus comprising supports for holding a roll of print media during printing.

A printing apparatus that is suitable for printing on a web of print media, for example a large format inkjet printer, is provided with supports suitable for holding a media roll and allowing the media to be unwound from the roll during the printing operation.

For example, the roll may be held in the printer supports by means of a spindle extending through the core of the roll and suitable to engage the supports; a hub is attached to the spindle at each end of the roll, so as to hold the roll in position on the spindle.

Every time a fresh media roll has to be loaded in the printer, a user has to remove the roll that has run out of media, together with its spindle and hubs, from the supports in the printer; disengage the spindle and hubs from the core of the old roll; prepare the new roll by engaging it with the spindle and hubs; and then lift the new roll assembly for placing it in the supports, which are usually on an upper part of the printing apparatus.

Since the media roll may be heavy and bulky, and usually there is little space available around the printing apparatus, all these operations the user has to perform are quite cumbersome.

In some cases handling or lifting carriages are employed for transporting large rolls of media, performing operations on them and lifting the roll to a work position in a press or printing apparatus; however, such devices take up floor space and are relatively costly, and this makes them inadequate for offices or similar premises.

Other solutions involve complex devices integrated in a printing apparatus, which at least partly automate the loading operation; however, such devices may increase costs to an unacceptable level, and due to their active intervention in the loading operation they need to be adapted e.g. to the structure of the apparatus and the roll media supports, and/or to the size of the roll.

SUMMARY

The present invention seeks to facilitate to a user the operations of preparing and loading a media roll in a printing apparatus, by means of a relatively simple and versatile solution.

According to a first aspect, the present invention relates to a printing apparatus comprising printing apparatus comprising supports for holding a roll of print media during printing, said supports being accessible from one side of the printer to insert a roll of print media, and an auxiliary media tray suitable for holding in a stable position a roll of print media placed with its outer surface resting on the tray, said auxiliary tray being attached to the printer on the same side of the printer from where the supports for the roll of print media are accessible.

The provision of such a tray in a printing apparatus is cost-effective and simplifies the work of a user that has to load a new media roll in the apparatus.

In a second aspect, the invention relates to a method for loading a roll of print media in a printing apparatus, comprising:

providing, on one side of the printing apparatus, supports for holding a roll of print media during printing and an auxiliary media tray suitable for holding in a stable position a roll of print media placed with its outer surface resting on the tray;

placing a roll of print media on said auxiliary tray;

attaching roll mounting parts to said roll of print media while it is placed on said auxiliary tray; and lifting the roll of print media with the attached roll mounting parts from the auxiliary tray and engaging the roll mounting parts in the supports for holding the roll of print media during printing.

According to a further aspect, the invention relates to an auxiliary media tray for a printing apparatus, comprising a media roll holding surface, whereby in use a roll of print may be held in a stable position when placed with its outer surface resting on the tray, and brackets for attachment to a printing apparatus.

DESCRIPTION OF DRAWINGS

Particular embodiments of the present invention will be described in the following, only by way of non-limiting example, with reference to the appended drawings, in which.

DETAILED DESCRIPTION

Figure 1:
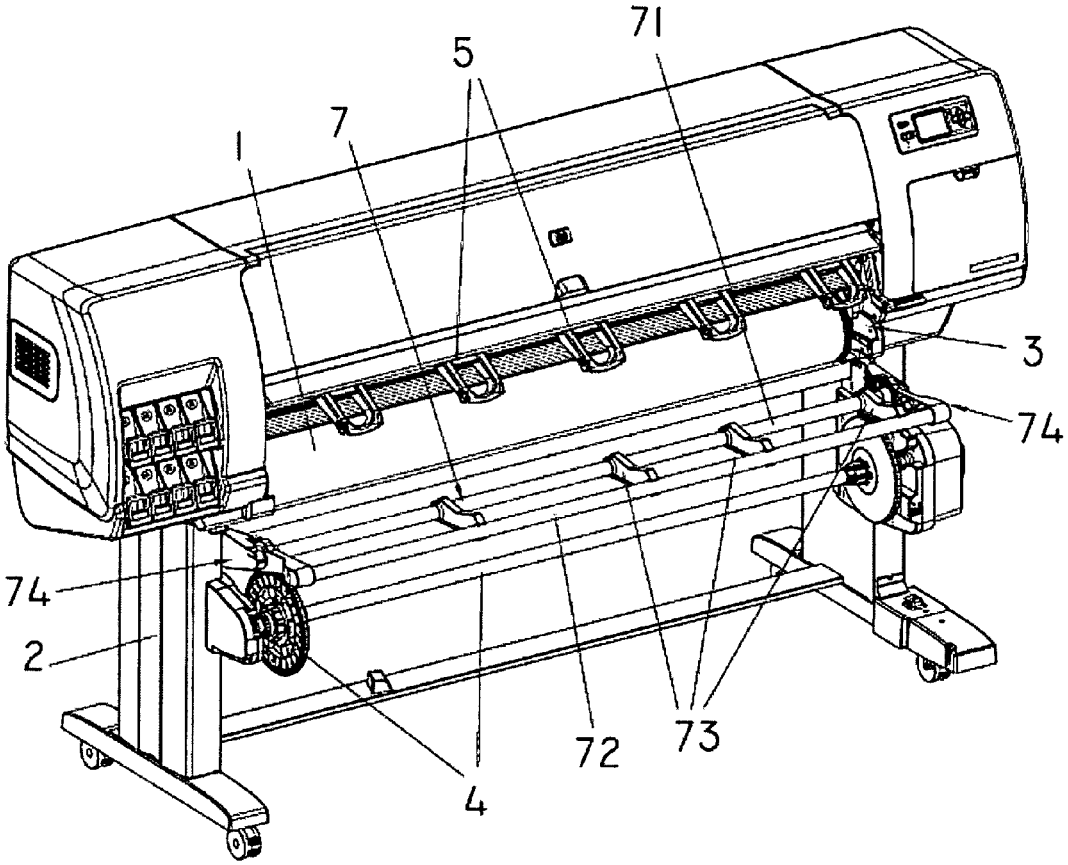
FIG. 1 is a schematic view showing in perspective a printing apparatus according to an embodiment of the present invention.

FIG. 1 shows a large format printer; in this example, it is a printer of the type in which a web of print media such as paper is fed from a media roll supported in the apparatus, travels through the printer where it is printed by means of inkjet printheads, and then wound on a take-up reel which is also supported in the apparatus.

Figure 2:
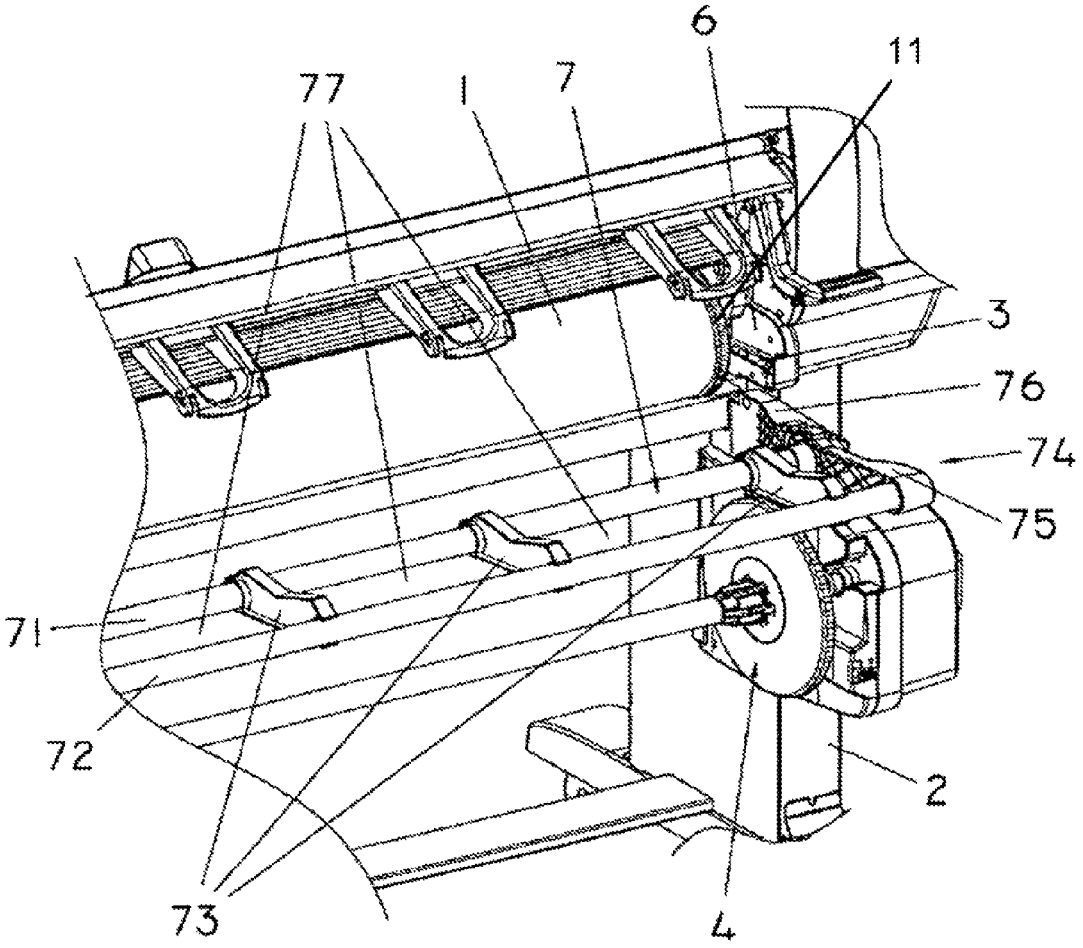
FIG. 2 shows an enlarged detail of FIG. 1.

FIGS. 1 and 2 show such a printer with a media roll 1 loaded in a printing position: the printer comprises a framework 2 on which are provided two side supports 3 for holding the media roll 1, and a take-up reel 4. In the perspective view of FIGS. 1 and 2 only one of the supports 3 for the media roll is visible; the other support is symmetrically arranged at the other end of the media roll 1.

The supports 3 for holding the media roll 1 are accessible from the side of the printer visible in FIGS. 1 and 2, in order to insert and remove the media roll; the supports 3 may include an input guide 6, as seen in FIG. 2, to facilitate the insertion of the roll in the correct position.

A roll of print media 1 may be arranged in the supports 3 of the printer by means of a set of roll mounting parts including a spindle that is inserted through the hollow core of the media roll and two lateral hubs that are attached to the spindle at the two ends of the roll. One of the hubs is partly visible in FIG. 2, and it is identified with reference numeral 11; the spindle and the other hub are not visible in the figures but they can be, for example, like the spindle and hubs of the take-up reel 4, clearly visible in the figures.

Reference numeral 5 indicates a number of tongues over which the media is guided when it is outputted from the printer and travels towards the take-up reel 4.

In the embodiment of the figures, the take-up reel 4 is arranged on the same side of the printer from where the supports 3 are accessible.

Other printing apparatuses don't have a take-up reel, and the printed media is collected on a tray or a stacker; or the take-up reel may be on the other side of the printer.

Figure 3:
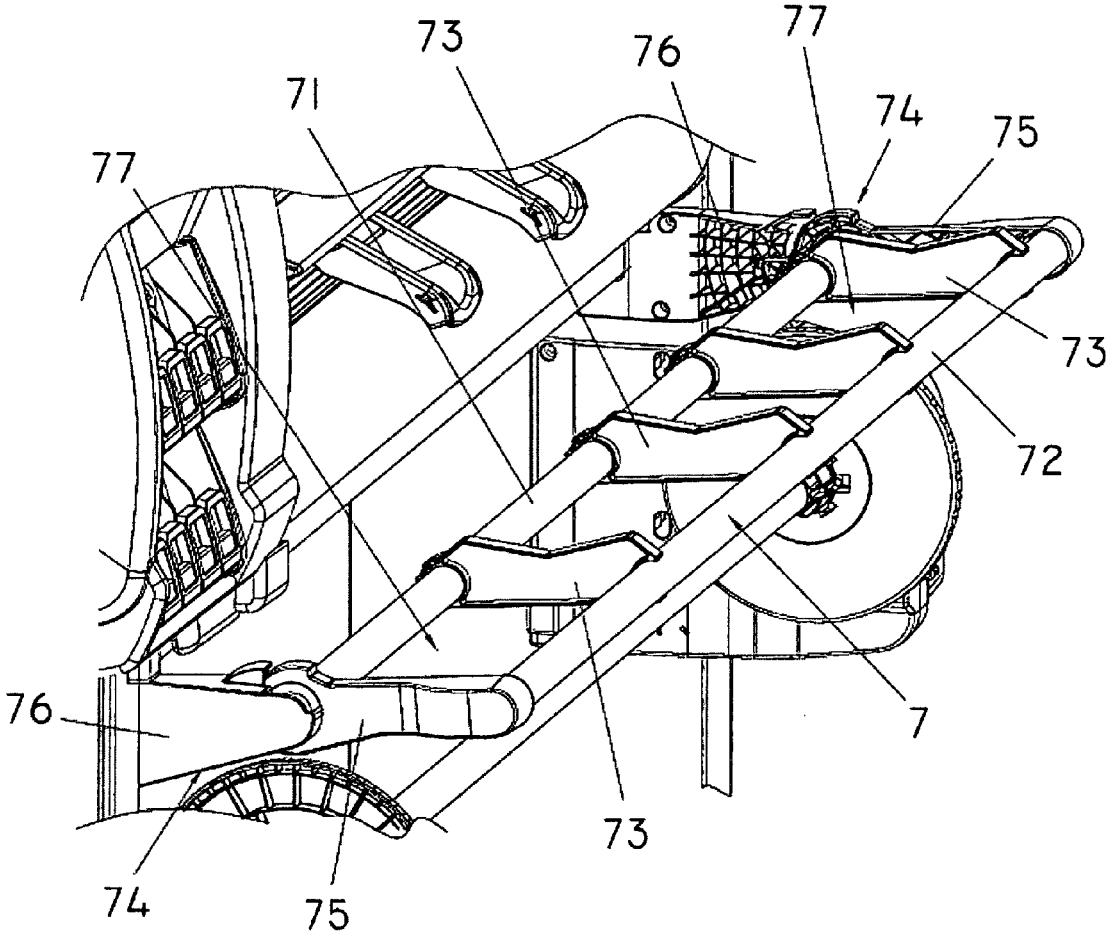
FIG. 3 shows the auxiliary tray of the printing apparatus, in working position.

An auxiliary media tray, indicated as a whole with reference numeral 7 and best seen in detail in FIG. 3, is attached to the framework 2 of the printer on the same side from where the supports 3 for holding the media roll during printing are accessible, and at a height which is below the supports 3.

This tray 7 is intended to serve as an auxiliary support for temporarily holding the media roll 1 in a stable position during the operation for loading a new media roll 1 the printer, which is carried out by a user.

The tray 7 may comprise two parallel bars 71 and 72, and a number of crosspieces 73 spanning the distance between the two bars. The crosspieces may have at their ends a shape matching the section of the bars such as to be snap-fitted to the bars 71, 72, as shown in the figures.

In this embodiment the roll is intended to be placed with its outer surface resting on the upper side of the crosspieces 73, which extend slightly above the level of the bars 71, 72; the upper side of the crosspieces thus define a media roll holding surface, i.e. a surface where the media roll is intended to rest when on the tray.

In order to provide stable support for the roll, the upper side of the crosspieces 73 has a concave configuration, here defined by two slopes converging towards the middle of the crosspiece.

The crosspieces 73 may slide along the bars 71, 72 in order to be placed in a suitable position, depending on the dimensions of the media roll 1.

Of course the media roll holding surface could be embodied in a different way from that shown in the drawings; for example, as a single molded piece, provided it is suitable for the function of supporting the media roll in a stable condition when it is placed such that its outer surface rests on the tray.

On the other hand, it will be understood that a concave configuration can adopt several particular shapes, such as rounded, triangular, trapezoidal or combinations thereof, and could also be embodied by two or more different elements.

Figure 4:
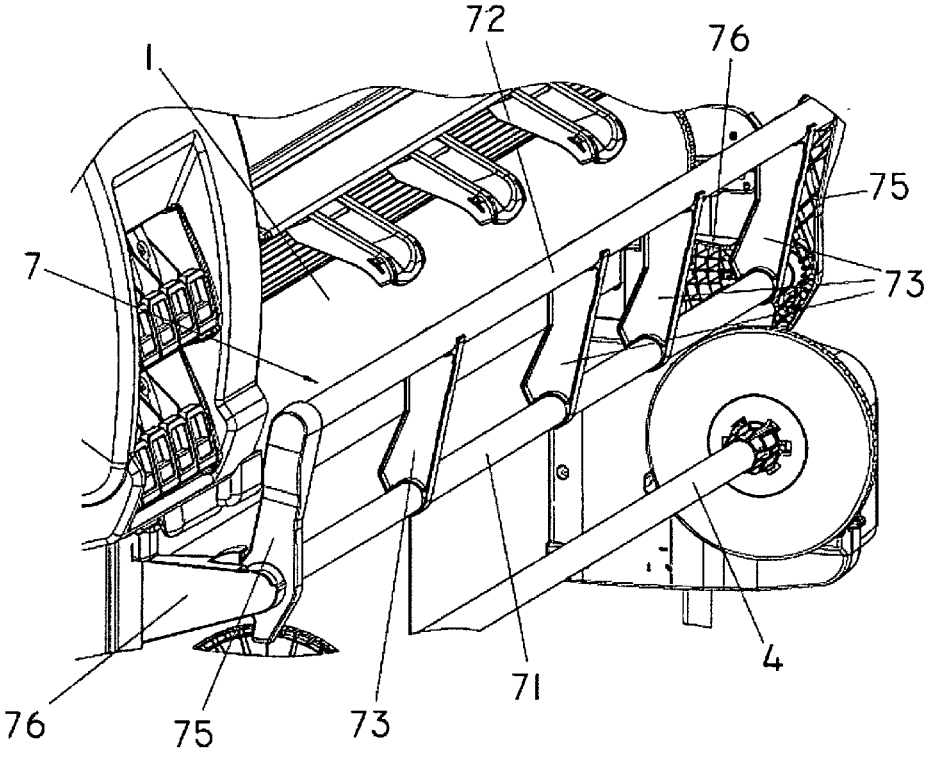
FIG. 4 shows the tray in a folded away position.

As shown in FIGS. 3 and 4, the tray 7 is attached to the framework 2 of the printer by means of mounting brackets 74. The two parallel bars 71, 72 of the tray 7 are fixed at their ends to a first bracket member 75, which is hinged with respect to a second bracket member 76, which in turn is bolted or fixed in any other way to the printer framework 2.

The hinge joint between the first bracket members 75 and the second bracket members 76 is such as to allow the tray 7 to rotate and adopt at least two releasable stable positions: it can for example be a mechanism with two stable stops or positions, "up" (the tray is folded against the side of the printer, as shown in FIG. 4) and "down" (the tray is unfolded and held horizontal, as shown in FIG. 3).

In the position of FIG. 3 the tray is substantially horizontal, such that it can hold a media roll 1 in a stable position, and projects from the side of the printer; in the position of FIG. 4 the tray 7 is stowed away, folded against the side of the printer.

The hinge joint between bracket members 75 and 76 may be suitable to maintain the tray 7 in the folded position of FIG. 4; in other embodiments the tray may remain in a similar folded-away position simply by gravity.

It will be noted that free spaces or openings 77 remain between the bars 71,72 and the crosspieces 73; these openings facilitate to a user the operation of lifting the media roll 1 from the tray 7, since they allow the user to insert his/her fingers under the roll and grip it easily from underneath. In other embodiments of the tray, suitably dimensioned recesses or openings of different configuration could be provided in the media roll holding surface to define gripping spaces for the same function.

When a user wants to load a new roll of print media in the above printer, after removing from the supports 3 the core of the roll that has run out of media, the user sets the auxiliary tray in the position of FIG. 3, and places the new roll of print media on the tray. The roll rests in stable condition on the tray, such that there is no risk that it rotates and falls from the tray.

Once the media roll is on the tray the user inserts a spindle, with a hub attached to it near one end, through the core of the media; afterwards the user places another hub on the spindle, at the other end, such that the media roll remains between the two hubs.

In order to insert the second hub on the spindle, a force has to be exerted in the axial direction of the media roll.

Since the hubs are slightly larger in diameter than the media roll, it will be noted that when the roll is resting on the tray 7, the hubs will project downwards slightly from the media roll supporting surface, here defined by the upper side of the crosspieces 73. Thus, if one of the crosspieces 73 is set at one end of the parallel bars 71 and 72, as shown at the right hand side of FIGS. 2 and 3, such that the media roll does not extend over it, then this crosspiece will constitute a stopper to the axial movement of the media roll once the spindle with one hub is inserted into the core of the roll, because the hub will abut against the crosspiece if the roll is pushed towards the right in FIGS. 2 and 3. This abutment facilitates to the user the insertion of the second hub on the spindle, since the media roll will be retained by the last crosspiece 73 instead of sliding axially with the risk of failing from the tray.

In other embodiments of the tray a different lateral abutment member can be foreseen, either associated to the bracket 75 or as a separate part.

In the media roll loading operation, once the roll is fitted with the spindle and hubs the user can lift the media roll assembly easily by gripping the roll from underneath, and insert it in the supports 3 through the corresponding guides 6, which are positioned only slightly above the tray. This operation is simple, and requires little strength due to the small distance and height to be covered, for example in some embodiments around 20 cm; it could even be performed with one hand, by first introducing one side of the roll and then rotate the roll and introduce the other side.

Furthermore, due to the dimensions of the printer, in general the tray is arranged at a very comfortable height for the user to perform all the operations and to pick up the media roll.

Figure 5:
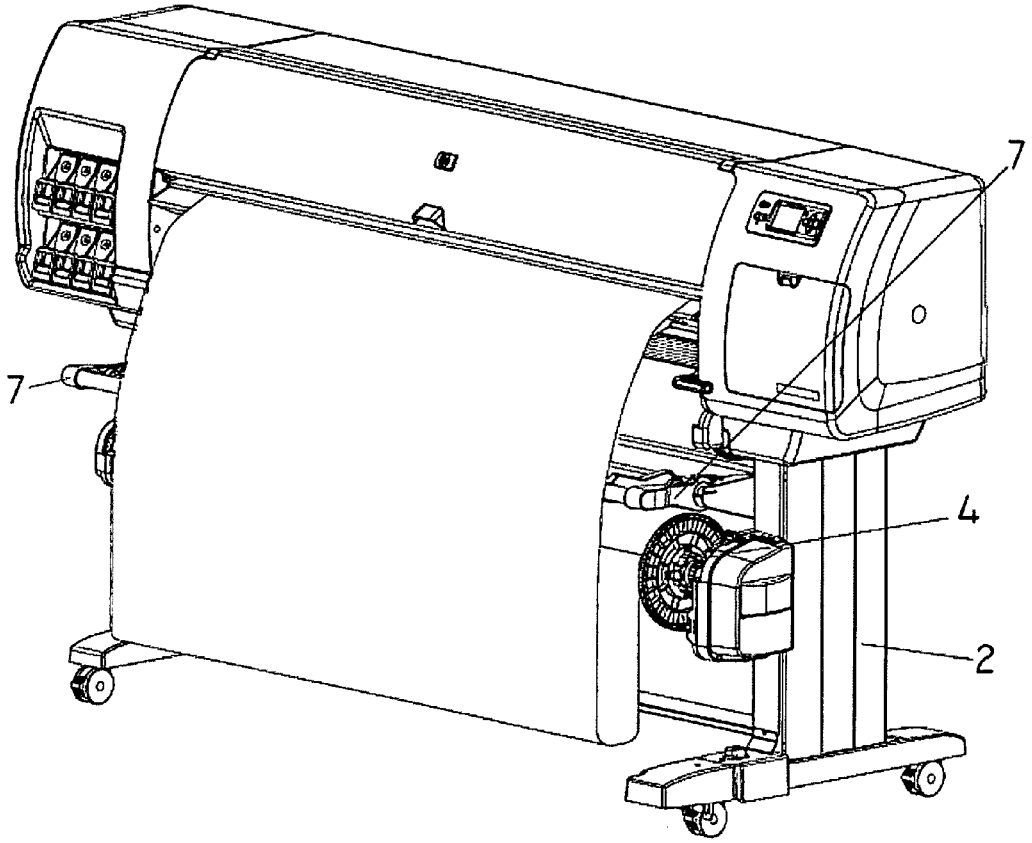
FIG. 5 shows the tray guiding the printed media that travels towards the take-up reel.

When the printer has a take-up reel 4 on the same side from which the supports 3 are accessible, then the tray 7 may be attached to the printer below the supports 3 and above the take-up reel 4. In this position the tray 7, which as shown in FIG. 3 has a proximal edge along the printer and a distal end projecting from the printer, can be also employed for guiding or deflecting the media that leaves the printer and travels towards the take-up reel 4, as shown schematically in FIG. 5.

A tray such as described can also be provided as a separate part or kit, to be attached on the framework of a printing apparatus by means of appropriate brackets or supports.

The invention claimed is:

1. A printing apparatus comprising supports for holding a roll of print media during printing, said supports being accessible from one side of the printing apparatus to insert a roll of print media, and an auxiliary media tray suitable for holding in a stable position the roll of print media placed with an outer surface of the print media resting on the auxiliary media tray, said auxiliary media tray being attached to the printing apparatus on the same side of the printing apparatus from where the supports for the roll of print media are accessible, wherein the auxiliary media tray comprises two parallel bars and at least two crosspieces joining the parallel bars, the crosspieces are slidable along the parallel bars, and when the roll of print media is on the auxiliary media tray the outer surface of the roll of print media contacts stationary surfaces of the crosspieces.

2. A printing apparatus as claimed in claim 1, wherein the auxiliary media tray is attached to the printing apparatus at a height below said supports for holding the roll of print media.

3. A printing apparatus as claimed in claim 1, wherein the auxiliary media tray is attached to the printing apparatus in such a way that it can adopt a first position in which it can hold the roll of print media in the stable position, and a second position in which it is stowed away.

4. A printing apparatus as claimed in claim 3, wherein in said first position the auxiliary media tray protrudes from the side of the printing apparatus.

5. A printing apparatus as claimed in claim 3, wherein in said second position the auxiliary media tray is folded against the side of the printing apparatus.

6. A printing apparatus as claimed in claim 5, wherein the auxiliary media tray is attached to the printing apparatus through hinge joints.

7. A printing apparatus as claimed in claim 1, wherein the at least two crosspieces have planar surfaces in a triangular configuration against which the roll of print media rests when the roll of print media is placed on the auxiliary media tray.

8. A printing apparatus as claimed in claim 1, wherein the crosspieces are spaced apart to provide an opening for a user to grip the outer surface of the roll of print media from underneath when the roll of print media is placed on the auxiliary media tray.

9. A printing apparatus as claimed in claim 1, wherein the stationary surfaces of the crosspieces in contact with the media roll are concave in shape.

10. A printing apparatus as claimed in claim 1, wherein at least one of the crosspieces is exposed to abut against a roll mounting part connected to the roll of print media to stop movement of the roll of print media in an axial direction when the roll of print media is placed with an outer surface of the print media in contact with the stationary surfaces of the crosspieces.

11. A printing apparatus as claimed in claim 1, further being adapted to hold on the same side of the apparatus from which the supports for the roll of print media are accessible, a media take-up reel for media outputted from the printing apparatus, wherein the auxiliary media tray is attached to the printing apparatus at a height above the position of the media take-up reel.

12. A printing apparatus as claimed in claim 11, wherein during printing the media outputted from the printing apparatus and travelling towards the media take-up reel is guided over the auxiliary media tray.

13. A printing apparatus as claimed in claim 1, wherein the printing apparatus is a large format inkjet printer.

14. An auxiliary media tray for a printing apparatus, comprising:

a support structure configured to hold in a stable position a roll of print media placed with an outer surface of the print media resting on the support structure, wherein the support structure comprises spaced-apart elongated bars extending parallel to an axial direction, and transverse elements that span the elongated bars, are movable in relation to the elongated bars, and have stationary surfaces that contact the outer surface of the roll of print media when the roll of print media is on the support structure; and brackets coupled to the support structure and configured to attach the auxiliary media tray to the printing apparatus.

15. An auxiliary media tray as claimed in claim 14, wherein each of the transverse elements has a concave surface exposed to contact the outer surface of the roll of print media when the roll of print media is placed with the outer surface of the print media resting on the support structure.

16. A printing apparatus, comprising:

supports for holding a roll of print media during printing, wherein the supports are configured to engage roll mounting parts attached to the roll of print media; and an auxiliary media tray configured to hold in a stable position the roll of print media placed with an outer surface of the print media resting on the auxiliary media tray, wherein the auxiliary media tray comprises spaced-apart elongated bars extending parallel to the axial direction, and transverse elements that span the elongated bars and contact the outer surface of the roll of print media resting on the auxiliary media tray, wherein at least one of the transverse elements is exposed to abut against a terminal end of the roll mounting parts to stop movement of the roll of print media in an axial direction when the roll of print media is placed with the outer surface of the print media resting on the auxiliary media tray.

17. The printing apparatus of claim 16, wherein the transverse elements are movable to different locations along the parallel bars, and when the roll of print media is on the auxiliary media tray the outer surface of the roll of print media contacts stationary surfaces of the transverse elements.

* * * * *